US009525218B2

(12) United States Patent
Wu et al.

(10) Patent No.: US 9,525,218 B2
(45) Date of Patent: Dec. 20, 2016

(54) CONDUCTIVE WIRE CONNECTION STRUCTURE OF RAIL-TYPE ELECTRICAL TERMINAL

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Chin-Jung Wu, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 14/954,055

(22) Filed: Nov. 30, 2015

(65) Prior Publication Data

US 2016/0164196 A1 Jun. 9, 2016

(30) Foreign Application Priority Data

Dec. 4, 2014 (TW) ..... 103221523 U

(51) Int. Cl.
*H01R 4/24* (2006.01)
*H01R 4/48* (2006.01)
*H01R 9/26* (2006.01)

(52) U.S. Cl.
CPC ..... *H01R 4/4818* (2013.01); *H01R 4/4827* (2013.01); *H01R 9/2675* (2013.01)

(58) Field of Classification Search
CPC ..... H01R 4/4818
USPC ..... 439/441
See application file for complete search history.

(56) References Cited

U.S. PATENT DOCUMENTS 7,115,001 B1 * 10/2006 Brockman ..... H01R 4/4827 439/441
7,833,047 B2 * 11/2010 Pizzi ..... H01R 4/4827 439/395
8,771,004 B2 * 7/2014 Fehling ..... H01R 4/4818 439/441
8,794,994 B2 * 8/2014 Kollmann ..... H01R 4/4836 439/441
8,998,634 B2 * 4/2015 Koellmann ..... H01R 9/26 439/441

* cited by examiner

*Primary Examiner* — Phuong Dinh
(74) *Attorney, Agent, or Firm* — Rosenberg, Klein & Lee

(57) ABSTRACT

A conductive wire connection structure of rail-type electrical terminal is able to reduce the yield of waste material in manufacturing, enhance heat dissipation effect and increase operational and motional stability in condition of structural simplification. The conductive wire connection structure includes a conductive support mounted in an insulation case. The conductive support is divided into two parts of a U-shaped support main body and a C-shaped wire connector. The wire connector is assembled with a metal leaf spring and disposed on the support main body together with the metal leaf spring for pivotally connecting with the grounding conductive wire coming from an apparatus. The wire connector and the metal leaf spring are respectively formed with insertion sections for assembling the wire connector with the metal leaf spring to help the support main body to hold the metal leaf spring and prevent the metal leaf spring from deflecting.

27 Claims, 8 Drawing Sheets

CONDUCTIVE WIRE CONNECTION STRUCTURE OF RAIL-TYPE ELECTRICAL TERMINAL

BACKGROUND OF THE INVENTION

1. Field of the Invention

The present invention relates generally to a conductive wire connection structure of rail-type electrical terminal, and more particularly to a conductive wire connection structure including a conductive support and a metal leaf spring. The conductive support is divided into two parts of a support main body and a wire connector. The support main body and the wire connector are respectively formed with specific configurations to reduce the yield of waste material in manufacturing. In addition, in condition of higher rigidity, the wire connector is assembled with the metal leaf spring to help in fixing the metal leaf spring and restricting the motional path of the metal leaf spring.

2. Description of the Related Art

A conventional electrical connection terminal includes a metal member or metal leaf spring enclosed in an insulation case (generally made of plastic material). When a conductive wire is inserted into the terminal, the metal leaf spring serves to press and hold the conductive wire to electrically connect therewith. The electrical connection terminal is arranged to latch on a grounding rail (or conductive rail) to set up a common grounding device for an electrical appliance or mechanical apparatus to conduct out the residual voltage or static of the apparatus. Various typical electrical connection terminals have been disclosed.

Such grounding conductor terminal includes an insulation case in which a conductive support is mounted. The conductive support is connected with multiple wire connectors. The wire connectors cooperate with a metal leaf spring assembled therein to together pivotally electrically contact or connect with the grounding wire coming from the machine or apparatus. The metal leaf spring includes a head end. After the conductive wire is inserted into the case, the head end serves to bite the conductive wire and prevent the conductive wire from easily detaching from the insulation case out of contact with the metal leaf spring. The conductive wire can be released from the contact of the metal leaf spring only when an operator uses a tool to extend into the case to push/press the head end of the metal leaf spring.

With respect to the manufacturing, operation and application of the assembling structure of the conventional rail-type electrical connection terminal:

1. The conductive support of the conventional electrical connection terminal has a complicated structure and is troublesome and time-consuming to manufacture. Therefore, the yield can be hardly promoted and a large amount of waste material is produced in the manufacturing process. For example, a conventional skill discloses a metal piece used in an electrical connection device. The metal piece is a metal plate. Two end sections of the metal plate are respectively punched to form a structure of base pin, a contact pin, an attachment pin, two sidewalls, two corresponding end regions, four bending edges, two acute-angle edges, end section, recessed section and protrusion section. The attachment pin is 90-degree bent in a first direction. The attachment pin and the contact pin are together 90-degree bent in a second direction to the base pin. The sidewalls are 90-degree bent in the first direction to insert the two acute-angle edges with each other. In addition, the end section is 90-degree bent in a third direction to together form a space for restricting the metal leaf spring.
2. Especially, in the case that the conventional integrally formed conductive support and wire connector are selectively made of copper material with good electrical conductivity, the rigidity or hardness of the conductive support and wire connector will be relatively low. Under such circumstance, it is impossible to effectively restrict the motion of the metal leaf spring. On the contrary, in the case that the conductive support is selectively made of a material with higher rigidity or hardness, (such as iron, steel, etc.), the electrical conductivity will be not idealistic. That is, it is hard to meet both the requirements of good electrical conductivity and high rigidity or hardness at the same time. In another conventional electrical connection terminal, the conductive support is made of high-rigidity or hardness steel material and coated with an external copper layer with good electrical conductivity. However, it is quite troublesome and time-consuming to manufacture such conductive support and the cost is relatively high.

Still with respect to the manufacturing, operation and application of the assembling structure of the conventional rail-type electrical connection terminal, the structural design for assembling the wire connector with the metal leaf spring is not idealistic. This leads to that the metal leaf spring can be hardly securely located in the wire connector in a true position.

Especially, in operation and use, when the conductive wire is inserted into the case and the wire connector, the conductive wire will first press down the metal leaf spring and then by means of the elastic force of the metal leaf spring, the metal leaf spring and the wire connector will together bite or clamp the conductive wire into electrical contact with the conductive wire. When the conductive wire is inserted into the case, it often takes place that the bare metal end of the conductive wire thrusts the case or deflects the metal leaf spring to scrape the case or is not stably held due to mass insertion operation and human error. Some conventional techniques have been disclosed to solve the above problems.

However, as well known by those who are skilled in this field, the heat generated by the current can be hardly conducted out of a closed wire connector structure. Not only the material cost of the closed wire connector is relatively high, but also high temperature and high resistance often take place in the closed wire connector to deteriorate the electrical conduction effect. This is not what we expect.

Basically, in assembling design, the rail-type electrical connection terminal or the conductive support, the wire connector and the metal leaf spring have some shortcomings. Therefore, it is tried by the applicant to redesign the assembling structure of the conductive support, the wire connector and the metal leaf spring to be different from the conventional structure and change the use form and practically widen the application range of the rail-type electrical connection terminal. For example, the conductive support of the electrical connection terminal and the fixing structure of the wire connector or the assembling relationship between the wire connector and the metal leaf spring are changed. Accordingly, the structures of the conductive support, the wire connector and the metal leaf spring are easy to manufacture. This improves the shortcomings of the conventional conductive support that the conventional conductive support has a complicated bending structure and is troublesome and time-consuming to manufacture and a large amount of waste material is produced in the manufacturing process. Moreover, in condition of higher rigidity or hardness, the conductive wire connection structure of rail-type electrical terminal of the present invention has very good electrical conductivity. Also, in condition of better heat dissipation effect than the conventional structure, the wire connector can help in fixing the metal leaf spring. Therefore, the present invention apparently improves the shortcomings of the conventional electrical connection terminal that the bare metal end of the conductive wire is apt to thrust the case or deflect the metal leaf spring to scrape the case and the conductive wire cannot be stably held. None of the above conventional skills substantially teaches or discloses any of the characteristics of the present invention.

SUMMARY OF THE INVENTION

It is therefore a primary object of the present invention to provide a conductive wire connection structure of rail-type electrical terminal, which is able to reduce the yield of waste material in manufacturing, enhance heat dissipation effect and increase operational and motional stability in condition of structural simplification. The conductive wire connection structure includes a conductive support mounted in an insulation case. The conductive support is divided into two parts of a U-shaped support main body and a C-shaped wire connector. The wire connector is assembled with a metal leaf spring and disposed on the support main body together with the metal leaf spring for pivotally connecting with the grounding conductive wire coming from a machine or an apparatus. The wire connector and the metal leaf spring are respectively formed with insertion sections for assembling the wire connector with the metal leaf spring to help the support main body to hold the metal leaf spring and prevent the metal leaf spring from deflecting.

In the above conductive wire connection structure of rail-type electrical terminal, two arm sections respectively perpendicularly extend from two ends of the support main body, whereby the support main body has a U-shaped cross section or configuration. The wire connector has a first side, a second side connected with the first side, a subsidiary side also connected with the first side, a third side connected with the second side and a fourth side connected with the third side. The second, third and fourth side together help in restricting and holding the metal leaf spring. The fourth side and the subsidiary side together define an opening, whereby the wire connector has a C-shaped cross section or configuration.

In the above conductive wire connection structure of rail-type electrical terminal, the insertion sections of the wire connector are respectively formed between the second and third sides and between the third and fourth sides in the form of notches. The insertion sections of the metal leaf spring are respectively formed on two sides of the metal leaf spring corresponding to the positions of the insertion sections of the wire connector. The insertion sections of the metal leaf spring are inserted in the notches of the insertion sections of the wire connector to securely assemble the metal leaf spring with the wire connector and help the support main body to hold the metal leaf spring and prevent the metal leaf spring from deflecting.

The present invention can be best understood through the following description and accompanying drawings, wherein:

DETAILED DESCRIPTION OF THE PREFERRED EMBODIMENTS

Figure 1:
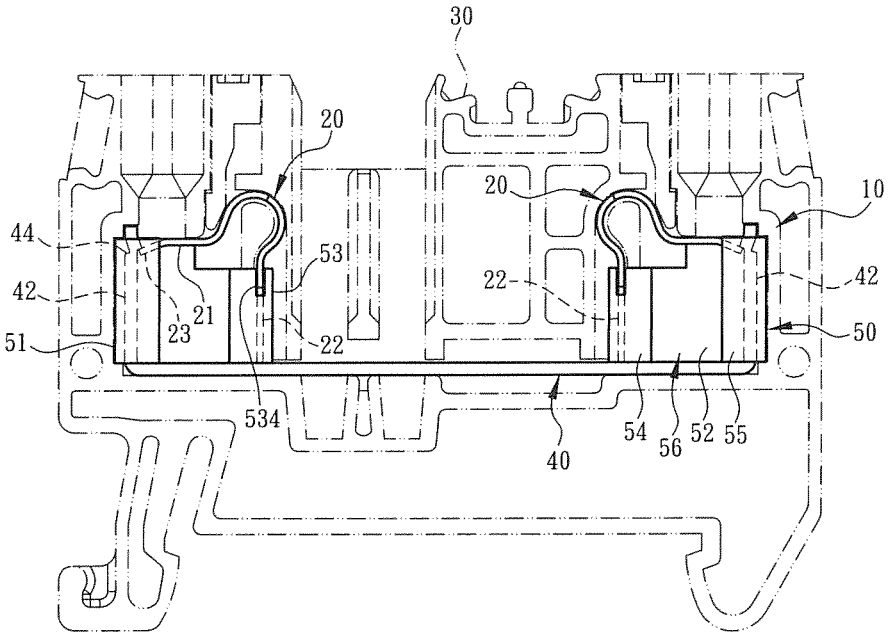
FIG. 1 is a plane view of the present invention, showing that the support main body and wire connector of the conductive support are assembled with the metal leaf spring.
Figure 2:
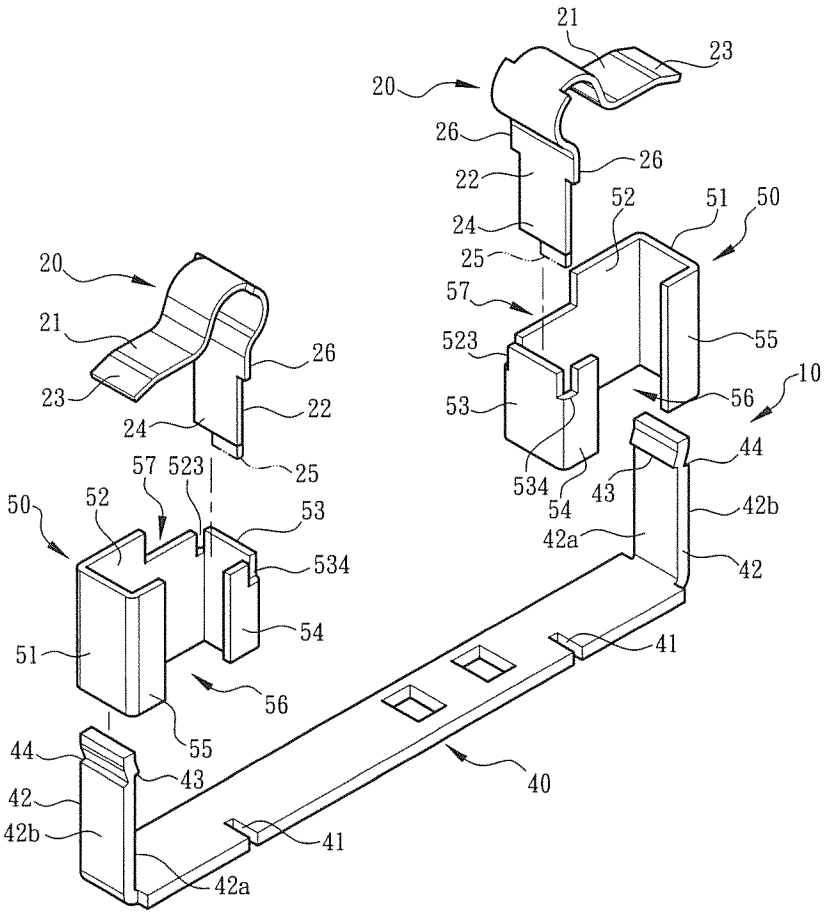
FIG. 2 is a perspective exploded view of the present invention, showing that the structures of the support main body and wire connector of the conductive support and the metal leaf spring.
Figure 3:
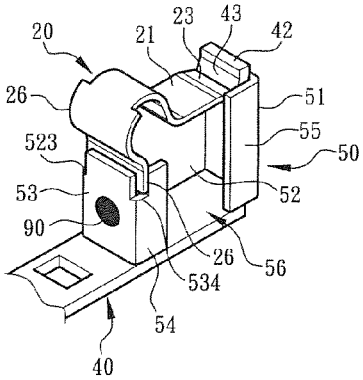
FIG. 3 is a perspective assembled view of the present invention, showing that the wire connector of the conductive support is welded with the metal leaf spring.

Please refer to FIGS. 1, 2 and 3. The conductive wire connection structure of rail-type electrical terminal of the present invention includes an assembly of a conductive support 10 and a metal leaf spring 20. The conductive support 10 and the metal leaf spring 20 are together mounted in an insulation case 30 for pivotally connecting with conductive wire and latching on a grounding rail (or conductive rail) to set up a common grounding device (not shown) for an electrical appliance or mechanical apparatus.

In a preferred embodiment, the conductive support 10 is divided into two parts, that is, a support main body 40 and a wire connector 50. The support main body 40 is selectively made of copper material with good electrical conductivity. The support main body 40 is formed with a notch 41 for assembling with the metal leaf spring 20. An arm section 42 perpendicularly extends from each of two ends of the support main body 40, whereby the support main body 40 has a U-shaped cross section or configuration. The arm section 42 has an inner face 42*a* and an outer face 42*b*. A shoulder section 43 is formed on the inner face 42*a*, while a recess 44 is formed on the outer face 42*b*. The shoulder section 43 serves to prevent a head end 23 of the metal leaf spring 20 from stretching and passing over the arm section 42 of the support main body 40 and the wire connector 50.

The metal leaf spring 20 includes a first section 21 and a second section 22 connected with the first section 21. The first section 21 has a head end 23 and the second section 22 has a tail end 24.

As shown by the phantom lines of the drawings, the tail end 24 is formed with a finger section 25 inserted in the notch 41 of the support main body 40. In addition, the head end 23 is leant against the shoulder section 43 of the arm section 42.

As shown in the drawings, the recess 44 serves to assemble with and locate the wire connector 50. The wire connector 50 is selectively made of a material with higher rigidity or hardness (such as iron, steel, etc.) in the form of a flat-plate blank material. The flat-plate blank material is manufactured into the wire connector 50 as shown in FIG. 2. In comparison with the conventional electrical terminal, the conductive support 10 of the present invention is divided into the support main body 40 and the wire connector 50 as two parts so that not only the support main body 40 of the conductive support 10 can meet the requirement of good electrical conductivity and the wire connector 50 can meet the requirement of rigidity or high hardness, but also the structure of the conductive support 10 is simplified to reduce the yield of waste material. Moreover, the formation of the structures of the support main body 40 and the wire connector 50 can be completed only by once or twice bending operation. This improves the shortcoming of the conventional technique that it is necessary to perform many times of bending operation in at least three different directions to manufacture the conductive support. Accordingly, the present invention can be more easily manufactured.

Please refer to FIGS. 2 and 3. The wire connector 50 includes a first side 51, a second side 52 perpendicularly connected with the first side, a third side 53 perpendicularly connected with the second side 52, a fourth side 54 perpendicularly connected with the third side 53 and a subsidiary side 55 perpendicularly connected with the first side 51. The subsidiary side 55 and the fourth side 54 together define an opening 56, whereby the wire connector 50 has a C-shaped cross section or configuration for receiving the metal leaf spring 20.

In a preferred embodiment, the wire connector 50 and the metal leaf spring 20 are respectively formed with insertion sections 523, 534, 26 on predetermined portions. By means of the insertion sections 523, 534, 26, the wire connector 50 is assembled with the metal leaf spring 20 to help the support main body 40 to hold the metal leaf spring 20.

To speak more specifically, the insertion sections 523, 534 of the wire connector 50 are in the form of notches respectively formed between the second and third sides 52, 53 and between the third and fourth sides 53, 54. Corresponding to the positions of the insertion sections 523, 534 of the wire connector 50, the insertion sections 26 of the metal leaf spring 20 are in the form of protrusion plates respectively formed on two sides of the second section 22 for securely inserting into and locating in the notches of the insertion sections 523, 534 of the wire connector 50. Accordingly, the wire connector 50 can be fixedly assembled with the metal leaf spring 20.

In this embodiment, at least one of the upper and lower regions of the second side 52 of the wire connector 50 is formed with a dent 57 as shown in the drawings. The dent 57 extends to the third and fourth sides 53, 54. That is, the dent 57 makes the width of the third and fourth sides 53, 54 smaller than the width of the first side 51 or the width of a part of the second side 52. Due to the opening 56 and the dent 57, the wire connector 50 is formed with a (half) open structure for providing heat dissipation effect in application.

FIGS. 2 and 3 also show that the wire connector 50 is assembled with the metal leaf spring 20 and together with the metal leaf spring 20 disposed on the support main body 40. The first side 51 (upper edge) of the wire connector is engaged with the recess 44 of the support main body 40. In addition, the first side 51 cooperates with the second side 52 and the subsidiary side 55 to together surround the arm section 42 of the support main body 40. Moreover, the second, third and fourth sides 52, 53, 54 of the wire connector together surround the second section 22 of the metal leaf spring 20 with the head end 23 of the first section 21 leant against the shoulder section 43 of the arm section 42. The second, third and fourth sides 52, 53, 54 of the wire connector together surround the second section 22 of the metal leaf spring 20 to help in fixing the metal leaf spring 20 and restricting the motion thereof.

It should be noted that when the conductive wire is inserted into the insulation case 30 and the wire connector 50 to press the first section 21 or the head end 23 of the metal leaf spring 20, the subsidiary side 55 and/or the second side 52 of the wire connector 50 together guide and restrict the motion of the metal leaf spring 20 so as to prevent the metal leaf spring 20 from deflecting to scrape the insulation case 30.

Please refer to FIG. 3. In a preferred embodiment, the third side 53 of the wire connector is welded with the second section 22 of the metal leaf spring 20 so as to more truly and securely assemble the wire connector 50 with the metal leaf spring 20.

Figure 4:
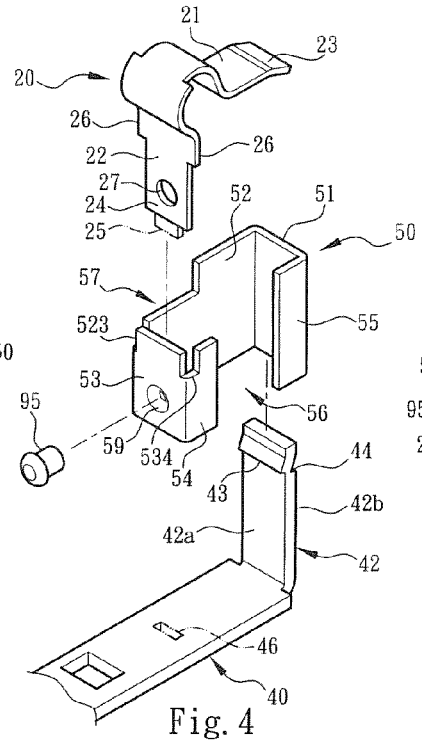
FIG. 4 is a perspective exploded view of another embodiment of the present invention.
Figure 5:
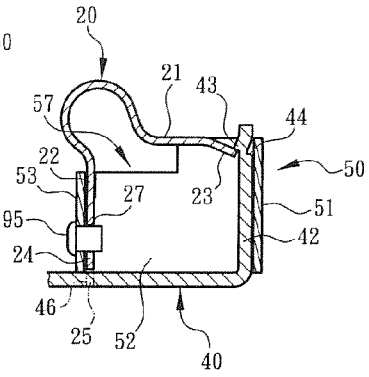
FIG. 5 is a sectional assembled view of the other embodiment of the present invention according to FIG. 4.

FIGS. 4 and 5 show a modified embodiment of the present invention. In this embodiment, the third side 53 of the wire connector and the second section 22 of the metal leaf spring 20 are respectively formed with assembling sections 59, 27 in the form of perforations. A fixing member 95 (such as a bolt, a screw, a rivet or the like) is passed through the assembling sections 59, 27 to securely assemble the wire connector 50 with the metal leaf spring 20.

FIGS. 4 and 5 also show that an insertion section 523 is formed between the second and third sides 52, 53 of the wire connector in the form of a notch. An insertion section 534 is formed between the third and fourth sides 53, 54 of the wire connector in the form of a notch. Two sides of the second section 22 of the metal leaf spring 20 are formed with insertion sections 26 corresponding to the insertion sections 523, 534. The insertion sections 26 are inserted in the insertion sections 523, 534 of the wire connector 50 to securely assemble the wire connector 50 with the metal leaf spring 20.

As shown by the phantom lines of FIGS. 4 and 5, the finger section 25 of the tail end 24 of the second section of the metal leaf spring 20 is inserted in an insertion hole 46 of the support main body 40 to help in fixing the metal leaf spring 20 with the support main body 40.

Figure 6:
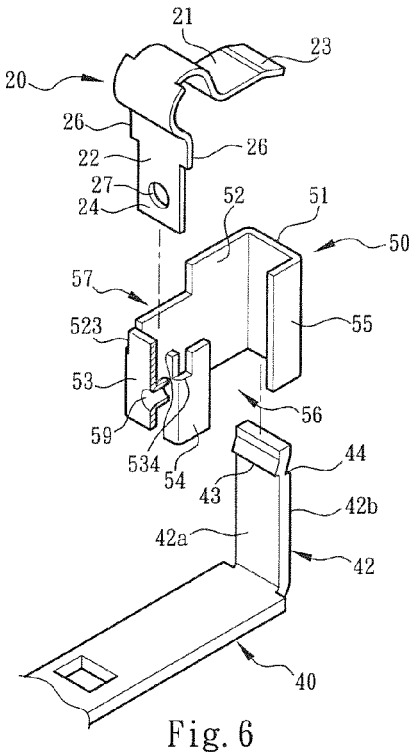
FIG. 6 is a perspective exploded view of still another embodiment of the present invention.
Figure 7:
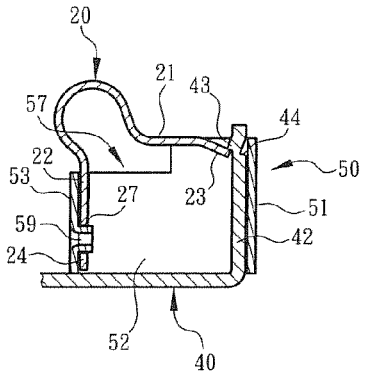
FIG. 7 is a sectional assembled view of the embodiment of the present invention according to FIG. 6.

Please refer to FIGS. 6 and 7. In a preferred embodiment, the assembling section 27 of the second section 22 of the metal leaf spring 20 is in the form of a perforation, while the assembling section 59 of the third side 53 of the wire connector 50 is in the form of a boss. The boss of the assembling section 59 is fitted in the perforation of the assembling section 27 of the metal leaf spring 20 to securely assemble the metal leaf spring 20 with the wire connector 50.

FIGS. 6 and 7 also show that an insertion section 523 is formed between the second and third sides 52, 53 of the wire connector in the form of a notch. An insertion section 534 is formed between the third and fourth sides 53, 54 of the wire connector in the form of a notch. Two sides of the second section 22 of the metal leaf spring 20 are formed with insertion sections 26 corresponding to the insertion sections 523, 534. The insertion sections 26 are inserted in the insertion sections 523, 534 of the wire connector 50 to securely assemble the wire connector 50 with the metal leaf spring 20.

Figure 8:
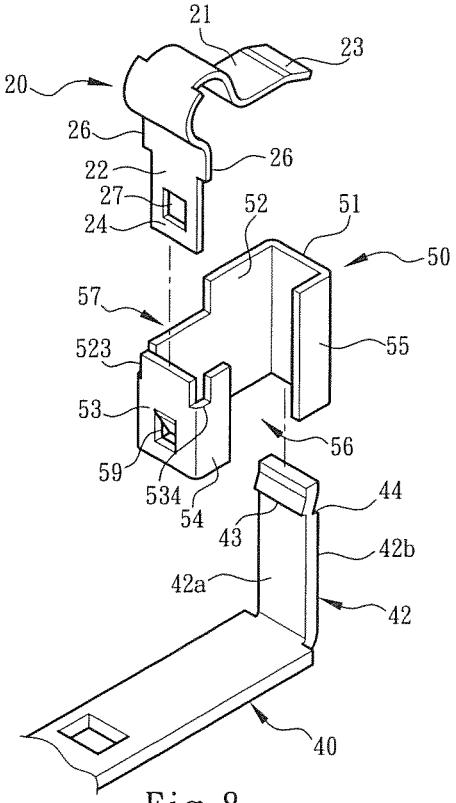
FIG. 8 is a perspective exploded view of still another embodiment of the present invention.
Figure 9:
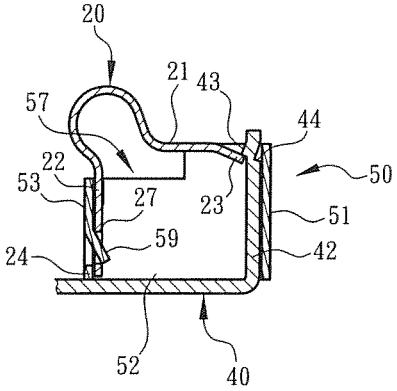
FIG. 9 is a sectional assembled view of the embodiment of the present invention according to FIG. 8.

FIGS. 8 and 9 show a modified embodiment of the present invention. In this embodiment, the assembling section 27 of the second section 22 of the metal leaf spring 20 is in the form of a perforation, while the assembling section 59 of the third side 53 of the wire connector 50 is in the form of a wing section slightly bent from the third side 53 toward the first side 51. The wing section is inserted in the perforation of the assembling section 27 of the metal leaf spring 20 to securely assemble the metal leaf spring 20 with the wire connector 50.

FIGS. 8 and 9 also show that an insertion section 523 is formed between the second and third sides 52, 53 of the wire connector in the form of a notch. An insertion section 534 is formed between the third and fourth sides 53, 54 of the wire connector in the form of a notch. Two sides of the second section 22 of the metal leaf spring 20 are formed with insertion sections 26 corresponding to the insertion sections 523, 534. The insertion sections 26 are inserted in the insertion sections 523, 534 of the wire connector 50 to securely assemble the wire connector 50 with the metal leaf spring 20.

Figure 10:
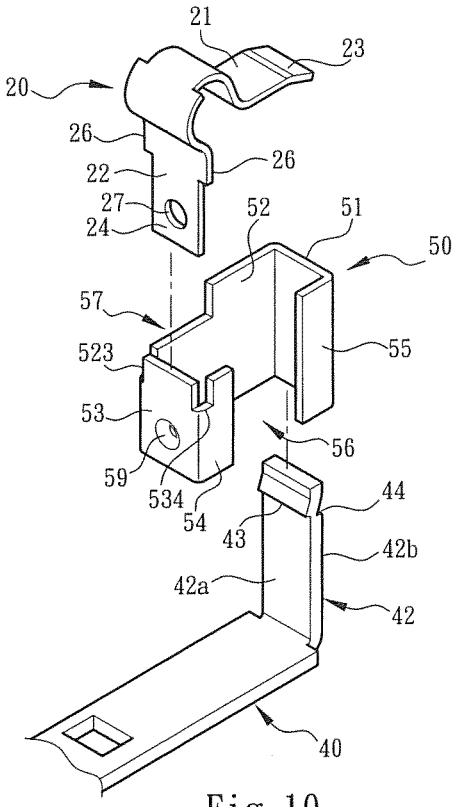
FIG. 10 is a perspective exploded view of still another embodiment of the present invention.
Figure 11:
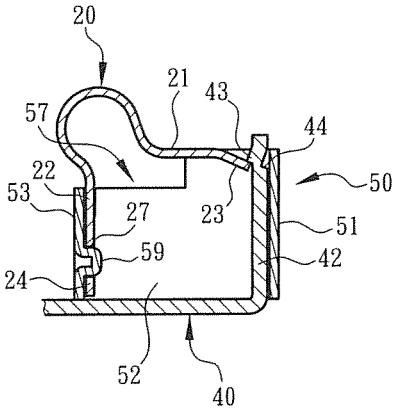
FIG. 11 is a sectional assembled view of the embodiment of the present invention according to FIG. 10.

FIGS. 10 and 11 show another modified embodiment of the present invention. In this embodiment, the assembling section 27 of the second section 22 of the metal leaf spring 20 is in the form of a perforation, while the assembling section 59 of the third side 53 of the wire connector 50 is in the form of a protruding stake protruding from the third side 53 toward the first side 51. The protruding stake is inserted in the perforation of the assembling section 27 of the metal leaf spring 20 to securely assemble the metal leaf spring 20 with the wire connector 50.

FIGS. 10 and 11 also show that an insertion section 523 is formed between the second and third sides 52, 53 of the wire connector in the form of a notch. An insertion section 534 is formed between the third and fourth sides 53, 54 of the wire connector in the form of a notch. Two sides of the second section 22 of the metal leaf spring 20 are formed with insertion sections 26 corresponding to the insertion sections 523, 534. The insertion sections 26 are inserted in the insertion sections 523, 534 of the wire connector 50 to securely assemble the wire connector 50 with the metal leaf spring 20.

Figure 12:
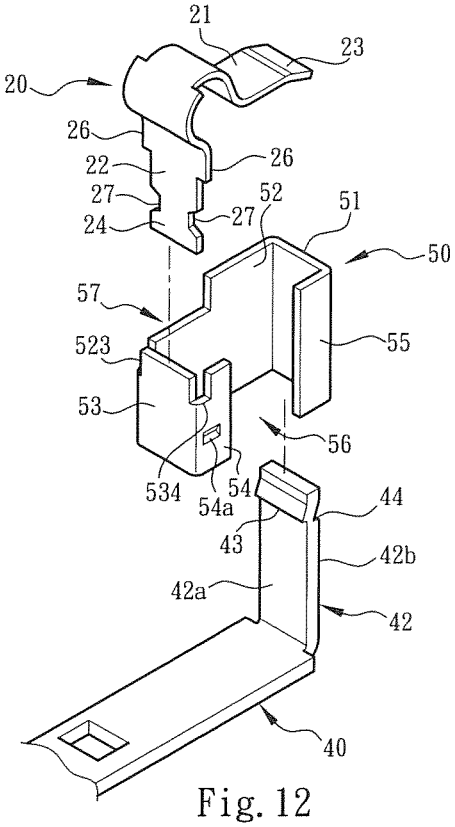
FIG. 12 is a perspective exploded view of still another embodiment of the present invention.
Figure 13:
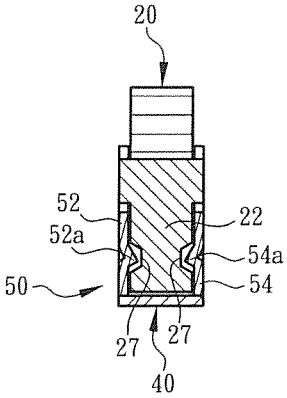
FIG. 13 is a sectional assembled view of the embodiment of the present invention according to FIG. 12.

FIGS. 12 and 13 show still another modified embodiment of the present invention. In this embodiment, the assembling section 27 of the metal leaf spring 20 is in the form of notches formed on two sides of the second section 22. Corresponding to the notches of the assembling section 27 on two sides of the second section 22, the second and fourth sides 52, 54 of the wire connector 50 are respectively formed with block-like insertion sections 52*a*, 54*a*. The insertion sections 52*a*, 54*a* are assembled with the notches of the assembling section 27 of the metal leaf spring 20 to securely assemble the metal leaf spring 20 with the wire connector 50.

FIGS. 12 and 13 also show that an insertion section 523 is formed between the second and third sides 52, 53 of the wire connector in the form of a notch. An insertion section 534 is formed between the third and fourth sides 53, 54 of the wire connector in the form of a notch. Two sides of the second section 22 of the metal leaf spring 20 are formed with insertion sections 26 corresponding to the insertion sections 523, 534. The insertion sections 26 are inserted in the insertion sections 523, 534 of the wire connector 50 to securely assemble the wire connector 50 with the metal leaf spring 20.

Figure 14:
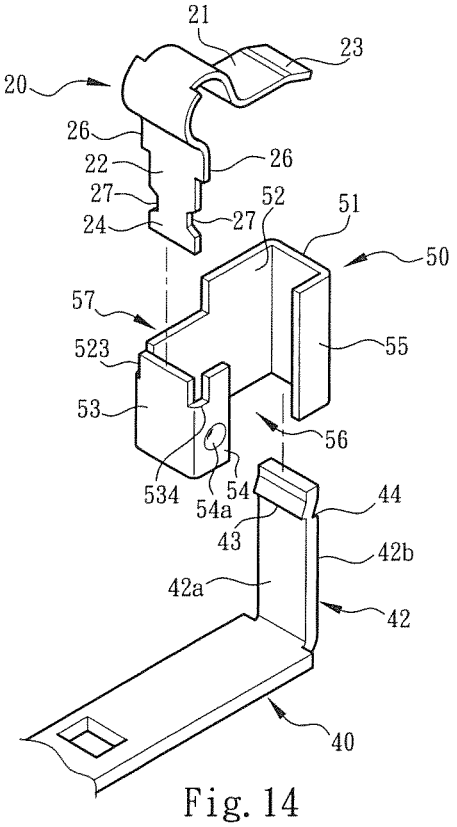
FIG. 14 is a perspective exploded view of still another embodiment of the present invention.
Figure 15:
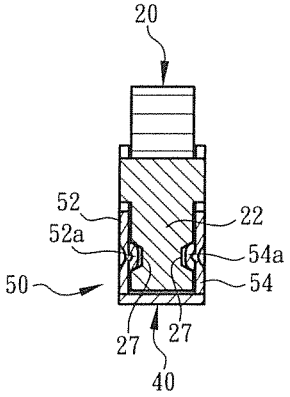
FIG. 15 is a sectional assembled view of the embodiment of the present invention according to FIG. 14.

FIGS. 14 and 15 show still another modified embodiment of the present invention. In this embodiment, the assembling section 27 of the metal leaf spring 20 is in the form of notches formed on two sides of the second section 22. Corresponding to the notches of the assembling section 27 on two sides of the second section 22, the second and fourth sides 52, 54 of the wire connector 50 are respectively formed with insertion sections 52*a*, 54*a* in the form of circular stakes. The insertion sections 52*a*, 54*a* are assembled with the notches of the assembling section 27 of the metal leaf spring 20 to securely assemble the metal leaf spring 20 with the wire connector 50.

FIGS. 14 and 15 also show that an insertion section 523 is formed between the second and third sides 52, 53 of the wire connector in the form of a notch. An insertion section 534 is formed between the third and fourth sides 53, 54 of the wire connector in the form of a notch. Two sides of the second section 22 of the metal leaf spring 20 are formed with insertion sections 26 corresponding to the insertion sections 523, 534. The insertion sections 26 are inserted in the insertion sections 523, 534 of the wire connector 50 to securely assemble the wire connector 50 with the metal leaf spring 20.

In conclusion, in condition of simplification of the structure, in comparison with the conventional electrical terminal, the conductive wire connection structure of rail-type electrical terminal of the present invention has the following advantages:

1. The support main body 40 and the wire connector 50 of the conductive support 10 and the relevant components of the present invention have been redesigned to be different from the conventional electrical terminal and change the use and operation form of the electrical terminal. (For example, the conductive support 10 is divided into two parts of the support main body 40 and the wire connector 50. The support main body 40 is selectively made of a material with good electrical conductivity and has a U-shaped cross section or configuration. The wire connector 50 is selectively made of a high-rigidity material and has a C-shaped cross section or configuration. The third side 53 of the wire connector is perpendicularly connected with the fourth side 54. The second, third and fourth sides 52, 53, 54 of the wire connector cooperate with each other to together hold the metal leaf spring 20. The insertion section 523 is formed between the second and third sides 52, 53. The insertion section 534 is formed between the third and fourth sides 53, 54. Two sides of the second section 22 of the metal leaf spring 20 are formed with the insertion sections 26 corresponding to the insertion sections 523, 534. The insertion sections 26 of the metal leaf spring 20 are assembled with the insertion sections 523, 534 of the wire connector 50. The subsidiary side 55 is perpendicularly connected with the first side 51. The subsidiary side 55 and the fourth side 54 together define the opening 56. The metal leaf spring 20 and the wire connector 50 are respectively formed with the assembling sections 27, 59). In practice, the present invention apparently improves the shortcomings of the conventional electrical terminal that the structure is complicated, the manufacturing process is troublesome and time-consuming and the cost is relatively high.

2. The fourth side 54 and the subsidiary side 55 of the wire connector 50 together define the opening 56. The second side 52 of the wire connector 50 is formed with a dent 57. Due to the opening 56 and the dent 57, the wire connector 50 is formed with a (half) open structure for providing better heat dissipation effect than the conventional structure. Moreover, the second, third and fourth sides 52, 53, 54 of the wire connector 50 together surround the second section 22 of the metal leaf spring. The wire connector 50 is formed with the insertion sections 523, 534 corresponding to the insertion sections 26 of the second section 22 of the metal leaf spring 20. This helps in restricting and locating the metal leaf spring 20. The subsidiary side 55 and/or the second side 52 of the wire connector 50 together guide and restrict the motional path of the metal leaf spring 20 pressed by the conductive wire. Therefore, the present invention apparently improves the shortcomings of the conventional electrical terminal that the bare metal end of the conductive wire is apt to thrust the case or deflect the metal leaf spring to scrape the case and the conductive wire cannot be stably held.

3. The fixing structure or assembling relationship between the support main body 40 and the wire connector 50 of the conductive support 10 and the metal leaf spring 20 of the electrical terminal have been apparent improved. In condition of higher rigidity or hardness and good electrical conductivity, the conductive wire connection structure of rail-type electrical terminal of the present invention is easy to manufacture. Therefore, the present invention improves the shortcoming of the conventional electrical terminal that it is necessary to perform many times of bending operation to manufacture the conductive support so that the conductive support has a complicated bending structure and a large amount of waste material is produced.

In conclusion, the conductive wire connection structure of rail-type electrical terminal of the present invention is different from the conventional electrical terminal in space form and is greatly advanced, inventive and advantageous over the conventional electrical terminal.

The above embodiments are only used to illustrate the present invention, not intended to limit the scope thereof. Many modifications of the above embodiments can be made without departing from the spirit of the present invention.

What is claimed is:

1. A conductive wire connection structure of rail-type electrical terminal, comprising a conductive support and a metal leaf spring, the conductive support being divided into two parts of a support main body and a wire connector, two arm sections respectively extending from two ends of the support main body to assemble with the wire connector, the wire connector including a first side, a second side connected with the first side, a third side connected with the second side and a fourth side connected with the third side for receiving the metal leaf spring, the metal leaf spring including a first section and a second section connected with the first section, the first section having a head end, the second section having a tail end, at least one insertion section being formed between the second and third sides and/or between the third and fourth sides of the wire connector, the second section of the metal leaf spring being formed with an insertion section corresponding to the insertion section of the wire connector, the insertion section of the metal leaf spring being inserted in the insertion section of the wire connector.

2. The conductive wire connection structure of rail-type electrical terminal as claimed in claim 1, wherein the arm sections respectively perpendicularly extend from two ends of the support main body, whereby the support main body has a U-shaped cross section, the first side of the wire connector being perpendicularly connected with the second side and a subsidiary side, the second side being perpendicularly connected with the third side, the third side being perpendicularly connected with the fourth side, the fourth side and the subsidiary side together defining an opening, whereby the wire connector has a C-shaped cross section, at least the subsidiary side serving to guide a motional path of the metal leaf spring, the insertion section of the wire connector being formed between the second and third sides in the form of a notch, another insertion section of the wire connector being formed between the third and fourth sides in the form of a notch, the insertion sections of the metal leaf spring being respectively formed on two sides of the second section of the metal leaf spring.

3. The conductive wire connection structure of rail-type electrical terminal as claimed in claim 2, wherein the first side of the wire connector cooperates with the second side and the subsidiary side to together surround the arm section of the support main body, the second, third and fourth sides of the wire connector together surrounding the second section of the metal leaf spring, the support main body, the wire connector and the metal leaf spring being together mounted in an insulation case.

4. The conductive wire connection structure of rail-type electrical terminal as claimed in claim 2, wherein the support main body is formed with one of a notch and an insertion hole for assembling with the metal leaf spring, the arm section having an inner face and an outer face, a shoulder section being formed on the inner face, while a recess being formed on the outer face, an upper edge of the first side of the wire connector being engaged with the recess, the first side of the wire connector cooperating with the second side and the subsidiary side to together surround the arm section of the support main body, the second, third and fourth sides of the wire connector together surrounding the second section of the metal leaf spring with the head end of the first section leant against the shoulder section of the arm section, a finger section being formed at the tail end of the second section of the metal leaf spring, the finger section being inserted in the notch or the insertion hole of the support main body, the support main body, the wire connector and the metal leaf spring being together mounted in an insulation case.

5. The conductive wire connection structure of rail-type electrical terminal as claimed in claim 1, wherein the support main body is made of a metal material with good electrical conductivity and the wire connector is made of a metal material with high rigidity, at least one of upper and lower regions of the second side of the wire connector being formed with a dent, the dent extending to the third and fourth sides, whereby the wire connector is formed with an at least half open structure.

6. The conductive wire connection structure of rail-type electrical terminal as claimed in claim 2, wherein the support main body is made of a metal material with good electrical conductivity and the wire connector is made of a metal material with high rigidity, at least one of upper and lower regions of the second side of the wire connector being formed with a dent, the dent extending to the third and fourth sides, whereby the wire connector is formed with an at least half open structure.

7. The conductive wire connection structure of rail-type electrical terminal as claimed in claim 1, wherein an assembling section is formed on the second section of the metal leaf spring and another assembling section is formed on the third side of the wire connector, the assembling sections being in the form of perforations, a fixing member being passed through the perforations of the assembling sections to securely assemble the metal leaf spring with the wire connector.

8. The conductive wire connection structure of rail-type electrical terminal as claimed in claim 2, wherein an assembling section is formed on the second section of the metal leaf spring and another assembling section is formed on the third side of the wire connector, the assembling sections being in the form of perforations, a fixing member being passed through the perforations of the assembling sections to securely assemble the metal leaf spring with the wire connector.

9. The conductive wire connection structure of rail-type electrical terminal as claimed in claim 5, wherein an assembling section is formed on the second section of the metal leaf spring and another assembling section is formed on the third side of the wire connector, the assembling sections being in the form of perforations, a fixing member being passed through the perforations of the assembling sections to securely assemble the metal leaf spring with the wire connector.

10. The conductive wire connection structure of rail-type electrical terminal as claimed in claim 1, wherein an assembling section is formed on the second section of the metal leaf spring and another assembling section is formed on the third side of the wire connector, the assembling section of the second section of the metal leaf spring being in the form of a perforation, while the assembling section of the third side of the wire connector being in the form of a boss, the boss being assembled with the perforation of the assembling section of the metal leaf spring.

11. The conductive wire connection structure of rail-type electrical terminal as claimed in claim 2, wherein an assembling section is formed on the second section of the metal leaf spring and another assembling section is formed on the third side of the wire connector, the assembling section of the second section of the metal leaf spring being in the form of a perforation, while the assembling section of the third side of the wire connector being in the form of a boss, the boss being assembled with the perforation of the assembling section of the metal leaf spring.

12. The conductive wire connection structure of rail-type electrical terminal as claimed in claim 5, wherein an assembling section is formed on the second section of the metal leaf spring and another assembling section is formed on the third side of the wire connector, the assembling section of the second section of the metal leaf spring being in the form of a perforation, while the assembling section of the third side of the wire connector being in the form of a boss, the boss being assembled with the perforation of the assembling section of the metal leaf spring.

13. The conductive wire connection structure of rail-type electrical terminal as claimed in claim 1, wherein an assembling section is formed on the second section of the metal leaf spring and another assembling section is formed on the third side of the wire connector, the assembling section of the second section of the metal leaf spring being in the form of a perforation, while the assembling section of the third side of the wire connector being in the form of a wing section bent from the third side, the wing section being assembled with the perforation of the assembling section of the metal leaf spring.

14. The conductive wire connection structure of rail-type electrical terminal as claimed in claim 2, wherein an assembling section is formed on the second section of the metal leaf spring and another assembling section is formed on the third side of the wire connector, the assembling section of the second section of the metal leaf spring being in the form of a perforation, while the assembling section of the third side of the wire connector being in the form of a wing section bent from the third side, the wing section being assembled with the perforation of the assembling section of the metal leaf spring.

15. The conductive wire connection structure of rail-type electrical terminal as claimed in claim 5, wherein an assembling section is formed on the second section of the metal leaf spring and another assembling section is formed on the third side of the wire connector, the assembling section of the second section of the metal leaf spring being in the form of a perforation, while the assembling section of the third side of the wire connector being in the form of a wing section bent from the third side, the wing section being assembled with the perforation of the assembling section of the metal leaf spring.

16. The conductive wire connection structure of rail-type electrical terminal as claimed in claim 1, wherein an assembling section is formed on the second section of the metal leaf spring and another assembling section is formed on the third side of the wire connector, the assembling section of the second section of the metal leaf spring being in the form of a perforation, while the assembling section of the third side of the wire connector being in the form of a protruding stake protruding from the third side toward the first side, the protruding stake being assembled with the perforation of the assembling section of the metal leaf spring.

17. The conductive wire connection structure of rail-type electrical terminal as claimed in claim 2, wherein an assembling section is formed on the second section of the metal leaf spring and another assembling section is formed on the third side of the wire connector, the assembling section of the second section of the metal leaf spring being in the form of a perforation, while the assembling section of the third side of the wire connector being in the form of a protruding stake protruding from the third side toward the first side, the protruding stake being assembled with the perforation of the assembling section of the metal leaf spring.

18. The conductive wire connection structure of rail-type electrical terminal as claimed in claim 5, wherein an assembling section is formed on the second section of the metal leaf spring and another assembling section is formed on the third side of the wire connector, the assembling section of the second section of the metal leaf spring being in the form of a perforation, while the assembling section of the third side of the wire connector being in the form of a protruding stake protruding from the third side toward the first side, the protruding stake being assembled with the perforation of the assembling section of the metal leaf spring.

19. The conductive wire connection structure of rail-type electrical terminal as claimed in claim 1, wherein an assembling section is formed on the second section of the metal leaf spring, the assembling section of the second section of the metal leaf spring being in the form of notches formed on two sides of the second section, corresponding to the notches of the assembling section on two sides of the second section, the second and fourth sides of the wire connector being respectively formed with block-like insertion sections, the block-like insertion sections being assembled with the notches of the assembling section of the metal leaf spring.

20. The conductive wire connection structure of rail-type electrical terminal as claimed in claim 2, wherein an assembling section is formed on the second section of the metal leaf spring, the assembling section of the second section of the metal leaf spring being in the form of notches formed on two sides of the second section, corresponding to the notches of the assembling section on two sides of the second section, the second and fourth sides of the wire connector being respectively formed with block-like insertion sections, the block-like insertion sections being assembled with the notches of the assembling section of the metal leaf spring.

21. The conductive wire connection structure of rail-type electrical terminal as claimed in claim 5, wherein an assembling section is formed on the second section of the metal leaf spring, the assembling section of the second section of the metal leaf spring being in the form of notches formed on two sides of the second section, corresponding to the notches of the assembling section on two sides of the second section, the second and fourth sides of the wire connector being respectively formed with block-like insertion sections, the block-like insertion sections being assembled with the notches of the assembling section of the metal leaf spring.

22. The conductive wire connection structure of rail-type electrical terminal as claimed in claim 1, wherein an assembling section is formed on the second section of the metal leaf spring, the assembling section of the second section of the metal leaf spring being in the form of notches formed on two sides of the second section, corresponding to the notches of the assembling section on two sides of the second section, the second and fourth sides of the wire connector being respectively formed with insertion sections in the form of circular stakes, the insertion sections in the form of circular stakes being assembled with the notches of the assembling section of the metal leaf spring.

23. The conductive wire connection structure of rail-type electrical terminal as claimed in claim 2, wherein an assembling section is formed on the second section of the metal leaf spring, the assembling section of the second section of the metal leaf spring being in the form of notches formed on two sides of the second section, corresponding to the notches of the assembling section on two sides of the second section, the second and fourth sides of the wire connector being respectively formed with insertion sections in the form of circular stakes, the insertion sections in the form of circular stakes being assembled with the notches of the assembling section of the metal leaf spring.

24. The conductive wire connection structure of rail-type electrical terminal as claimed in claim 5, wherein an assembling section is formed on the second section of the metal leaf spring, the assembling section of the second section of the metal leaf spring being in the form of notches formed on two sides of the second section, corresponding to the notches of the assembling section on two sides of the second section, the second and fourth sides of the wire connector being respectively formed with insertion sections in the form of circular stakes, the insertion sections in the form of circular stakes being assembled with the notches of the assembling section of the metal leaf spring.

25. The conductive wire connection structure of rail-type electrical terminal as claimed in claim 1, wherein the third side of the wire connector is welded with the second section of the metal leaf spring.

26. The conductive wire connection structure of rail-type electrical terminal as claimed in claim 2, wherein the third side of the wire connector is welded with the second section of the metal leaf spring.

27. The conductive wire connection structure of rail-type electrical terminal as claimed in claim 5, wherein the third side of the wire connector is welded with the second section of the metal leaf spring.

* * * * *